US009689400B2

(12) United States Patent
Bacic et al.

(10) Patent No.: US 9,689,400 B2
(45) Date of Patent: Jun. 27, 2017

(54) FLUIDIC ACTUATOR

(71) Applicant: ROLLS-ROYCE PLC, London (GB)

(72) Inventors: Marko Bacic, Oxford (GB); Ronald William Daniel, Oxford (GB)

(73) Assignee: ROLLS-ROYCE plc, London (GB)

( * ) Notice: Subject to any disclaimer, the term of this patent is extended or adjusted under 35 U.S.C. 154(b) by 952 days.

(21) Appl. No.: 14/031,644

(22) Filed: Sep. 19, 2013

(65) Prior Publication Data

US 2014/0112765 A1 Apr. 24, 2014

(30) Foreign Application Priority Data

Oct. 22, 2012 (GB) ..... 1218927.0

(51) Int. Cl.

| | |
|---|---|
| ***F01D 11/06*** | (2006.01) |
| ***F01D 11/10*** | (2006.01) |
| ***F04D 29/16*** | (2006.01) |
| ***F15C 1/22*** | (2006.01) |
| ***F01D 11/20*** | (2006.01) |

(52) U.S. Cl.

CPC ..... *F04D 29/16* (2013.01); *F01D 11/06* (2013.01); *F01D 11/10* (2013.01); *F01D 11/20* (2013.01); *F05D 2270/62* (2013.01)

(58) Field of Classification Search

CPC ..... F01D 11/06; F01D 11/10; F01D 11/20; F04D 29/16; F05D 2270/62

See application file for complete search history.

(56) References Cited

U.S. PATENT DOCUMENTS 2,509,913 A * 5/1950 Espenschied ..... B06B 1/04 290/4 D
3,403,509 A * 10/1968 Eastman ..... F15C 1/002 137/804
3,854,401 A * 12/1974 Fisher ..... F42C 15/29 102/205
4,020,693 A 5/1977 Ahlgren et al.

FOREIGN PATENT DOCUMENTS

GB 1216913 A * 12/1970 ..... G01K 11/24

OTHER PUBLICATIONS

Feb. 12, 2013 Search Report issued in British Patent Application No. GB1218927.0.

Raman et al; "The powered resonance tube: From Hartmann's discovery to current active flow control applications;" Progress in Aerospace Sciences; 2009; Vo. 45; pp. 97-123.

* cited by examiner

*Primary Examiner* — Igor Kershteyn
(74) *Attorney, Agent, or Firm* — Oliff PLC

(57) ABSTRACT

A fluidic actuator comprising: a fluid nozzle for delivering fluid and a tube having an open end and a closed end, the open end spaced from the fluid nozzle. Also a pair of electrodes mounted in the tube and spaced apart to create a spark gap therebetween. A voltage source is arranged to supply a voltage across the pair of electrodes wherein the voltage causes plasma formation in the spark gap thereby shortening the effective length of the tube.

17 Claims, 5 Drawing Sheets

FLUIDIC ACTUATOR

The present invention relates to a fluidic actuator. The fluidic actuator may be used for controlling a clearance. In particular, the fluidic actuator of the present invention is for controlling a clearance between a rotor and a stationary casing in a gas turbine engine, or between a stator vane and rotating rims in a gas turbine engine, or in a seal arrangement. The present invention will be described with respect to a gas turbine engine for powering an aircraft, although other applications are envisaged.

A gas turbine engine 10 is shown in FIG. 1 and comprises an air intake 12 and a propulsive fan 14 that generates two airflows A and B. The gas turbine engine 10 comprises, in axial flow A, an intermediate pressure compressor 16, a high pressure compressor 18, a combustor 20, a high pressure turbine 22, an intermediate pressure turbine 24, a low pressure turbine 26 and an exhaust nozzle 28. A nacelle 30 surrounds the gas turbine engine 10 and defines, in axial flow B, a bypass duct 32.

Each of the fan 14, compressors 16, 18 and turbines 22, 24, 26 comprise one or more rotor stages having blades radiating from a hub. The blades are surrounded by a casing which may be formed of segments. It is necessary to have a small gap between the radially outer tips of the blades and the surrounding casing so that there is a running clearance between the components. The casing and blades are subject to radial growth due to heating and centrifugal forces during engine running. The casing and blades grow radially at different rates, dependent on their mass, shape and other factors, and therefore the gap between the blade tips and the casing varies during the engine run cycle.

For the gas turbine engine 10 to be efficient, it is desirable to minimise the gap between the radially outer tips of the blades and the surrounding casing since air that leaks through this gap does not do work on the subsequent turbine stage or is not compressed by the compressor stage. Nevertheless, it is also desirable to prevent blade tip rub against the casing which damages the components, thereby shortening their lives, and may introduce vibration into the rotor stage.

It is known to control the blade tip clearance gap size by active or passive methods. For example, relatively cool air may be supplied to the casing to reduce its radial dimension during a cruise phase of the flight cycle. Mechanical actuation of portions of the casing to move them radially inwardly or outwardly may also be used to change the gap between the blade tips and the casing.

One problem with known methods of controlling the blade tip clearance is that they are unable to respond quickly enough to changes experienced during transient manoeuvres, such as slam accelerations. Known methods and devices may also be bulky and/or complex. Where devices use mechanical actuation, it is difficult to provide components having a sufficient life to be cost-effective since there may be as many as 30,000 individual movements of the components during a single long-haul flight (8 hour duration).

The present invention provides a fluidic actuator that seeks to address the aforementioned problems.

Accordingly the present invention provides a fluidic actuator comprising: a fluid nozzle for delivering fluid; a tube having an open end and a closed end, the open end spaced from the fluid nozzle; a pair of electrodes mounted in the tube and spaced apart to create a spark gap therebetween; and a voltage source arranged to supply a voltage across the pair of electrodes wherein the voltage causes plasma formation in the spark gap thereby shortening the effective length of the tube.

Advantageously, the fluidic actuator of the present invention can be used to control a clearance more quickly than known arrangements because it has no moving mechanical parts.

The pair of electrodes may be axially aligned and circumferentially spaced. Alternatively the pair of electrodes may be circumferentially aligned and axially spaced.

There may be more than one pair of electrodes. There may be more than one voltage source. One voltage source may be arranged to supply one or more pairs of electrodes.

There may be a controller connected to the voltage source to control the supply of voltage. The voltage source may be arranged to supply a voltage of 1 kV to 20 kV. The voltage source may be controlled by a square wave function.

The tube may have a circular or rectangular cross-section. The tube may have a constant diameter for all its axial length or may have a different diameter at points along its axial length.

The present invention also provides a rotor sub-assembly comprising a rotor having an array of blades, a casing segment surrounding the rotor blades and a fluidic actuator as described, the fluidic actuator arranged to supply fluid to a clearance control arrangement.

The present invention also provides a seal arrangement comprising the fluidic actuator described comprising a seal segment, a rotating component against which the seal acts and a clearance control arrangement arranged to receive fluid from the fluidic actuator.

The present invention also provides a gas turbine engine comprising a fluidic actuator as described, a rotor sub-assembly as described and a seal arrangement as described.

Any combination of the optional features is encompassed within the scope of the invention except where mutually exclusive.

The present invention will be more fully described by way of example with reference to the accompanying drawings, in which.

Figure 1:
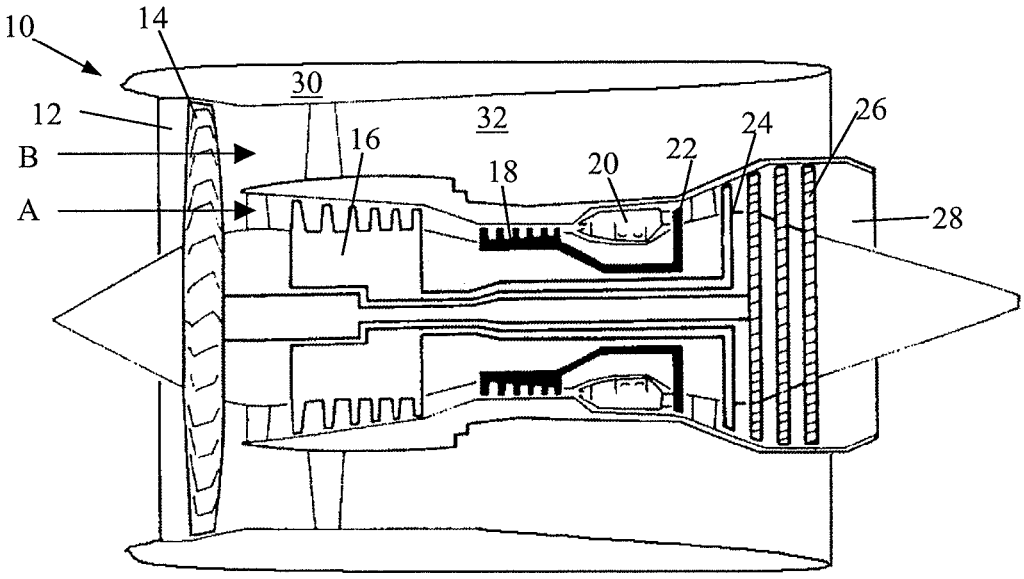
FIG. 1 is a sectional side view of a gas turbine engine.
Figure 2:
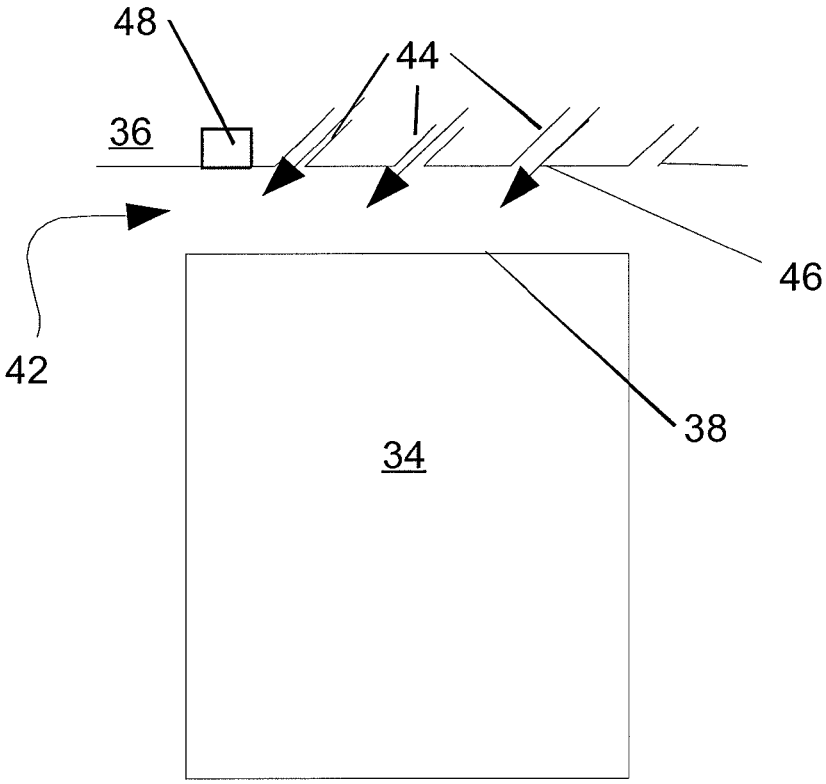
FIG. 2 is a schematic axial section through a blade and segment to which a clearance control device having a fluidic actuator according to the present invention may be applied.

FIG. 2 shows one application of the present invention. A blade 34, which is one of a circumferential array about a hub (not shown), is located radially inwardly of a casing segment 36. The blade 34 has a tip 38 at its radially outer edge. Between the blade tip 38 and the segment 36 is a clearance 40 through which air leaks as shown by arrow 42. The segment 38 includes a plurality of passages 44 through which injection air is delivered as shown by arrows 46. Preferably the passages 44 form an angle α with the plane surface of the segment 36 that defines part of the clearance 40. The angle α may be 1° to 90°, more preferably 30° to 60°. The passages 44 are angled so that the injection air 46 is delivered in a direction that substantially opposes the direction of flow of the leakage air 42. As illustrated, the leakage air 42 travels from left to right and the injection air 46 has an element that travels from right to left.

The angle α is chosen for each specific application of the present invention so that the injection air 46 forms vortices in the clearance 40. The vortices act to substantially block the clearance 40 so that the leakage air 42 is unable to pass through the clearance 40. Instead the leakage air 42 is forced to pass over the blade 34 and do useful work, thereby improving the efficiency of the engine 10.

As will be apparent to the skilled reader, the array of blades rotates at a speed from which the passing frequency can be calculated. The passing frequency is the period with which a specified point on consecutive blades 34 passes a specified point on the segment 36. There may be a sensor 48 positioned on the segment 36 to sense the passing of each blade 34. The signal from the sensor 48 can then be processed to determine the passing frequency of the blades 34 which can be passed to a control arrangement.

The injection air 46 may be supplied from a variety of sources. However, it may typically be air bled from an upstream compressor stage. The efficiency gain from supplying injection air 46 to form vortices in the clearance 40 must be weighed against the efficiency drop from extracting working air from the compressor stages to supply as injection air 46. The amount of injection air 46 can be reduced by supplying injection air 46 through the passages 44 only when a blade 34 is circumferentially aligned with the passages 44 and cutting off the supply in the period between blades 34 passing.

For a turbine stage rotating at approximately 10,000 rpm the passing frequency of the blade tips 38 is approximately 10 kHz and therefore the period is approximately 100 μs. A blade 34 passes the passages 44 for approximately ⅓ of this time, 33 μs, due to its width. Thus injection air 46 can most efficiently be supplied for 33 μs and then stopped for 66 μs, coincident with the passing of the blades 34 forming the array.

The segment 36 will preferably comprise a circumferential array of passages 44 so that injection air 46 can be supplied to form vortices in the clearance 40 above more than one blade tip 38 in the array of blades 34. More preferably, there will be more passages 44 than there are blades 34 in the array of blades 34 and the passages 44 will be distributed with denser circumferential spacing than the blades 34 so that injection air 46 can be supplied to the clearance 40 above all the blade tips 38 simultaneously. Alternatively, the circumferential array of passages 44 may be arranged so that vortices are formed above subsets of the array of blades 34 in a defined sequence. Alternatively there may be the same number of passages 44 in the circumferential array as there are blades 34.

There may be an axial array of passages 44 aligned with each passage 44 in the circumferential array. Alternatively, axially adjacent circumferential arrays may be circumferentially offset. The passages 44 may be coupled to a supply manifold (not shown) that supplies the injection air 46, or more than one manifold each of which supplies a subset of the passages 44.

Figure 3:
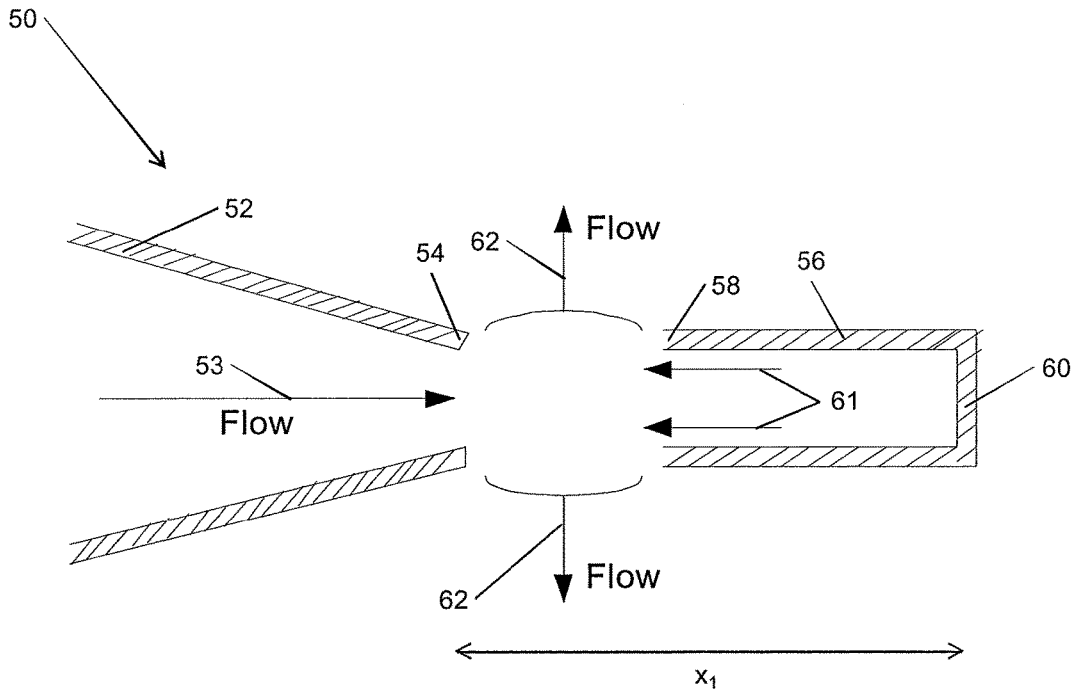
FIG. 3 is a known Hartmann oscillator.

A fluidic actuator 64 according to the present invention is based on a Hartmann oscillator 50 as shown in FIG. 3. The Hartmann oscillator 50 comprises a fluid nozzle 52 through which fluid is delivered. The fluid nozzle 52 may have a convergent shape so that the fluid jet shown by arrow 53 issuing from its exit 54 is unexpanded. The Hartmann oscillator 50 also comprises a tube 56 spaced apart from the fluid nozzle 52 and having a common longitudinal axis with it. In the simplest arrangement the tube 56 is cylindrical. The tube 56 has an open end 58 which faces the exit 54 of the fluid nozzle 52 and a closed end 60. The effective length $x_1$ of the Hartmann oscillator 50 is the distance between the exit 54 of the fluid nozzle 52 and the closed end 60 of the tube 56. The closed end 60 of the tube 56 reflects fluid, as shown by arrows 61, issued from the exit 54 of the fluid nozzle 52 towards the space between the tube 56 and the fluid nozzle 52. The interaction of the reflected fluid 61 from the tube 56 and more fluid 53 being issued from the exit 54 of the fluid nozzle 52 causes fluid to be ejected radially as shown by arrows 62.

Figure 4:
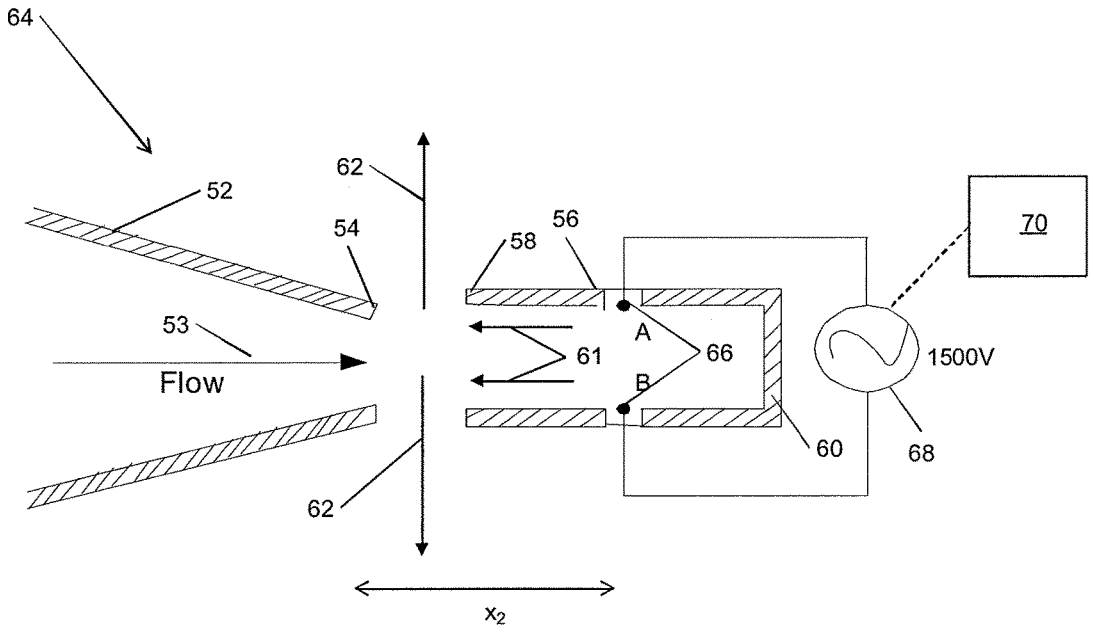
FIG. 4 is a schematic section of a fluidic actuator according to the present invention.

FIG. 4 shows one embodiment of a fluidic actuator 64 according to the present invention. The fluidic actuator 64 shares the features of the Hartmann oscillator 50 and may act as a Hartmann oscillator 50 when required. However, the fluidic actuator 64 additionally comprises a pair of electrodes 66 labeled A and B respectively, which are mounted in or on the wall of the tube 56. The electrodes 66 are spaced apart, in this embodiment being diametrically opposed in the cylindrical tube 56 but at the same axial distance from the open end 58 of the tube 56. The electrodes 66 are connected to a voltage source 68 which is configured to supply voltages between 1 kV and 20 kV. The size of voltage required is dependent on the spacing of the electrodes 66 as will become apparent. Energising of the voltage source 68 is controlled by a controller 70, with the control signal being indicated by dashed lines.

When the controller 70 sends a control signal to the voltage source 68 it applies a large voltage between the electrodes 66. This causes a spark to cross the gap between A and B which, because it is high voltage, causes the air within the tube 56 to be ionised and therefore to create a plasma. The plasma generated across the gap forms a barrier to fluid flow and causes a pressure wave to travel approximately perpendicular to the plasma, thus towards the open end 58 and closed end 60 of the tube 56. This has the effect that fluid is reflected back from the plasma formed between the electrodes 66 instead of the closed end 60 and thus the effective length of the tube 56 is reduced to $x_2$. Advantageously, this provides a fluidic actuator 64 that can act at two different frequencies, firstly when the effective length is $x_1$ and secondly when the voltage source 68 is energised to reduce the effective length to $x_2$.

The ejected fluid 62 may be captured in a passage or channel, not shown, that is coupled to one or more passages 44 of a clearance control arrangement. In some applications the space between the exit 54 of the fluid nozzle 52 and the open end 58 of the tube 56 may be constrained so that ejected fluid 62 may only travel in certain directions instead of in all radial directions. Beneficially, the ejected fluid 62 can therefore be directed towards the passages 44 of a clearance control arrangement or be directed to another arrangement requiring pulsed fluid flow. It will be understood by the skilled reader that it is necessary to carefully arrange any passage or channel around the space between the exit 54 of the fluid nozzle 52 and the open end 58 of the tube 56 to ensure that the walls do not affect the flow paths of the fluidic actuator 64 and thereby impede its satisfactory action.

For the tip clearance control application discussed above, it is beneficial to energise the voltage source 68 periodically so that shortening the effective length to $x_2$ coincides with a blade 34 passing the passages 44 through the segment 36 in order to supply fluid to the clearance 40 to block the leakage air flow 42. Thus the control signal from the controller 70 may take the form of a square wave with suitable period. Alternatively it may be sinusoidal for some applications.

Figure 5:
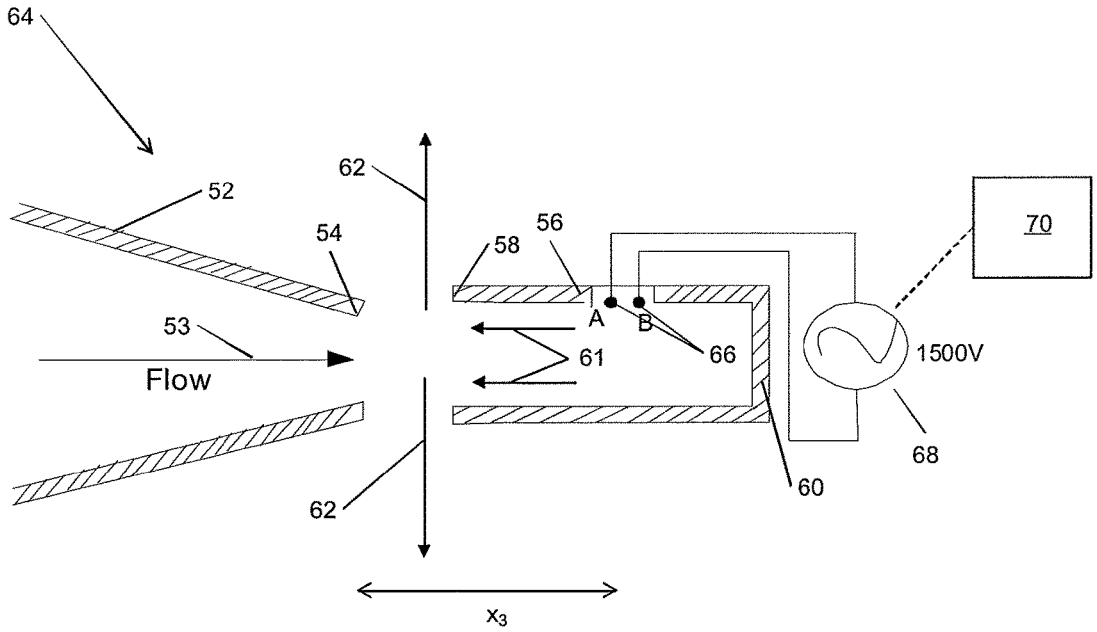
FIG. 5 is a schematic section of another fluidic actuator according to the present invention.

FIG. 5 shows a second embodiment of the fluidic actuator 64 according to the present invention. This embodiment differs from that illustrated in FIG. 4 in that the pair of electrodes 66 are spaced axially and are circumferentially aligned. This has the effect that the spark generated between A and B which ionises the fluid therebetween into a plasma causes a pressure wave to travel across the tube 56. Thus it is the pressure wave that acts to form a virtual wall to reflect the fluid flow, thereby reducing the effective length to $x_3$. As will be apparent, the electrodes 66 can be positioned at any suitable axial distance from the open end 58 of the tube 56 so that effective length $x_3$ is suitable for the desired application. Therefore the effective length $x_3$ may be the same or different to effective length $x_2$ in the previous embodiment. The electrodes 66 may be closer together in the embodiment of FIG. 5 than in the embodiment of FIG. 4. Advantageously, this means that the voltage required to cause a spark that can generate plasma between A and B is lower.

Figure 6:
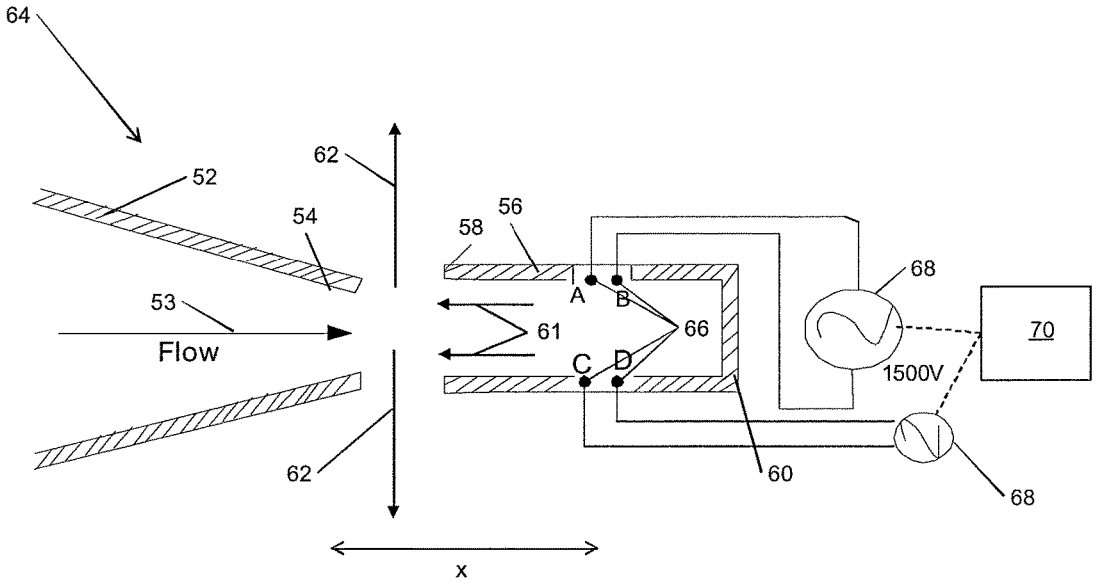
FIG. 6 is a schematic section of a further fluidic actuator according to the present invention.

FIG. 6 illustrates a further embodiment of the fluidic actuator 64 of the present invention. In this embodiment there are four electrodes 66 labeled A, B, C and D. The electrodes 66 are paired so that A and B are connected to a first voltage source 68 while C and D are connected to a second voltage source 68. Both voltage sources 68 are controlled by controller 70, although it is within the scope of the present invention to provide a separate controller 70 for each voltage source 68. Similarly, each pair of electrodes 66 may be connected to the same voltage source 68 rather than being connected to one voltage source 68 per pair of electrodes 66.

As illustrated, the electrodes 66 are paired so that each pair acts as in the embodiment described with respect to FIG. 5. The electrodes A and B are arranged to be diametrically opposed to the electrodes C and D, with A and C being at the same axial distance from the open end 58 of the tube 56 and B and D also being at the same axial distance as each other. Thus the spark gap between A and B is the same as that between C and D.

Figure 7:
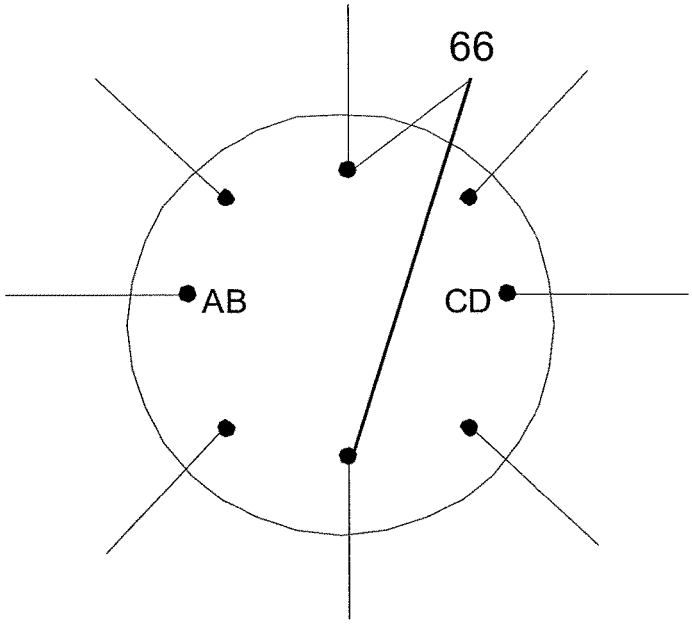
FIG. 7 is a schematic circumferential section of electrodes of a spark gap arrangement.

FIG. 7 illustrates a cross-section through FIG. 6 and shows eight pairs of electrodes 66, each indicated by a single dot, which are arranged as a regular circumferential array. Each pair of electrodes 66 is arranged as A and B or C and D are arranged in FIG. 6. Alternatively, electrodes 66 may be paired diametrically or in some other sequence.

The controller 70 acts to energise the voltage sources 68 to create a spark between one or more pairs of electrodes 66. Advantageously, there are several different control schemes available. For example, diametrically opposed pairs of electrodes 66 such as AB, CD may receive voltage simultaneously so that the required voltage is less than for a single pair since the pressure wave from each pair of electrodes 66 need only cross the radius, not the diameter, of the tube 56. Diametrically opposed pairs of electrodes 66 may then be energised in sequence so that a substantially continuous plasma is created to reflect fluid. The sequence may be a simple clockwise or anticlockwise progression or may be a more complex sequence to ensure appropriate stability of the flow.

Figure 8:
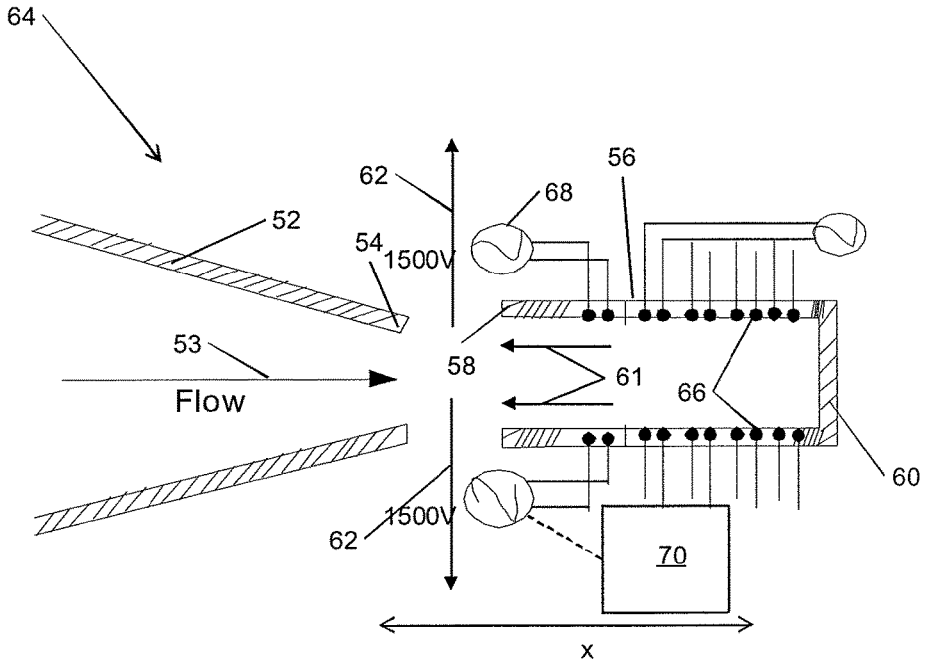
FIG. 8 is a schematic section of a further fluidic actuator according to the present invention.
Figure 9:
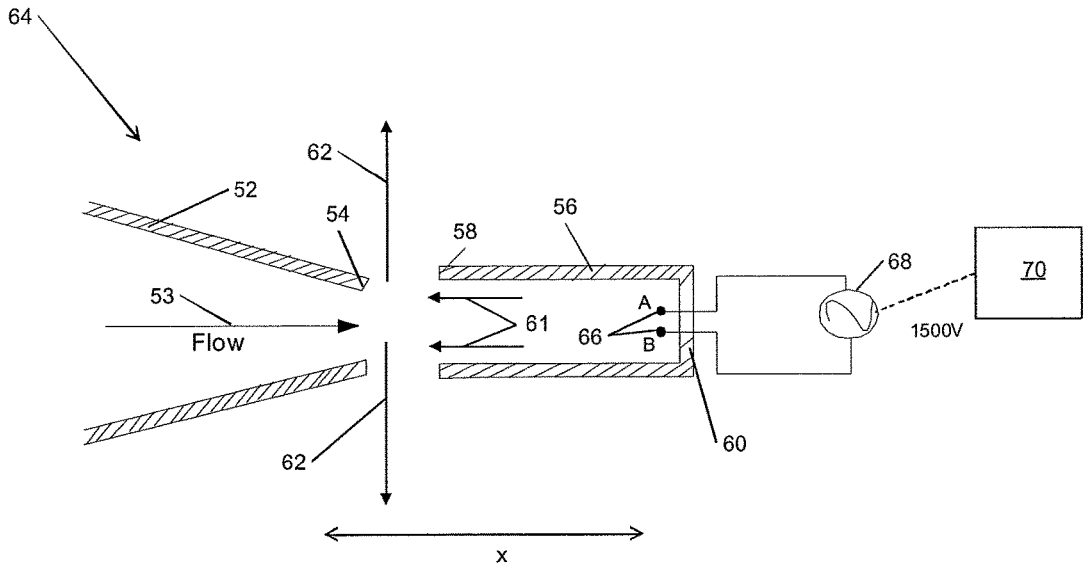
FIG. 9 is a schematic section of a further fluidic actuator according to the present invention.

FIG. 9 illustrates another embodiment of the fluidic actuator 64 according to the present invention having a different arrangement of electrodes 66. In this embodiment each pair of electrodes 66 is axially spaced. At each axial distance from the open end 58 of the tube 56 are two pairs of electrodes 66 that are diametrically opposed, or more pairs distributed in a circumferential array such as that illustrated in FIG. 7. The embodiment of FIG. 8 comprises electrode pairs at five different axial distances from the open end 58 of the tube 56. Each pair of electrodes 66 is coupled to a voltage source 68 which is controlled by a controller 70. As in the embodiment of FIG. 6, there may be a voltage source 68 for each pair of electrodes 66 or each voltage source 68 may supply more than one pair of electrodes 66. Similarly, there may be a single controller 70 which is configured to control all the voltage sources 68 or there may be more than one controller 70 each controlling a subset of the voltage sources 68.

Advantageously, pairs of electrodes 66 at a given axial distance from the open end 58 of the tube 56 can be energised to form plasma. Thus this embodiment enables six different effective lengths x, one defined to the closed end 60 of the tube 56 and the other five defined to the position of plasma formation dependent on which pair of electrodes 66 has been energised with voltage from a voltage source 68. Thus the fluidic actuator 64 of the embodiment illustrated in FIG. 8 has variable frequency ejected fluid 62. This may be beneficial in some applications, for example to block leakage flow 42 through the clearance 40 between a blade tip 38 and a segment 36 at a variety of blade passing frequencies.

FIG. 9 illustrates a further embodiment of the fluidic actuator 64 in which a pair of electrodes 66 are mounted in or on the closed end 60 of the tube 56. Preferably, the electrodes 66 are mounted from the closed end 60 but stand away from the closed end 60 so that when plasma is formed by applying a voltage across the electrodes 66 it shortens the effective length x. The spark gap may be up to the diameter of the tube 56 and causes the pressure wave to travel towards the open end 58 of the tube 56 to reflect the fluid.

Figure 10:
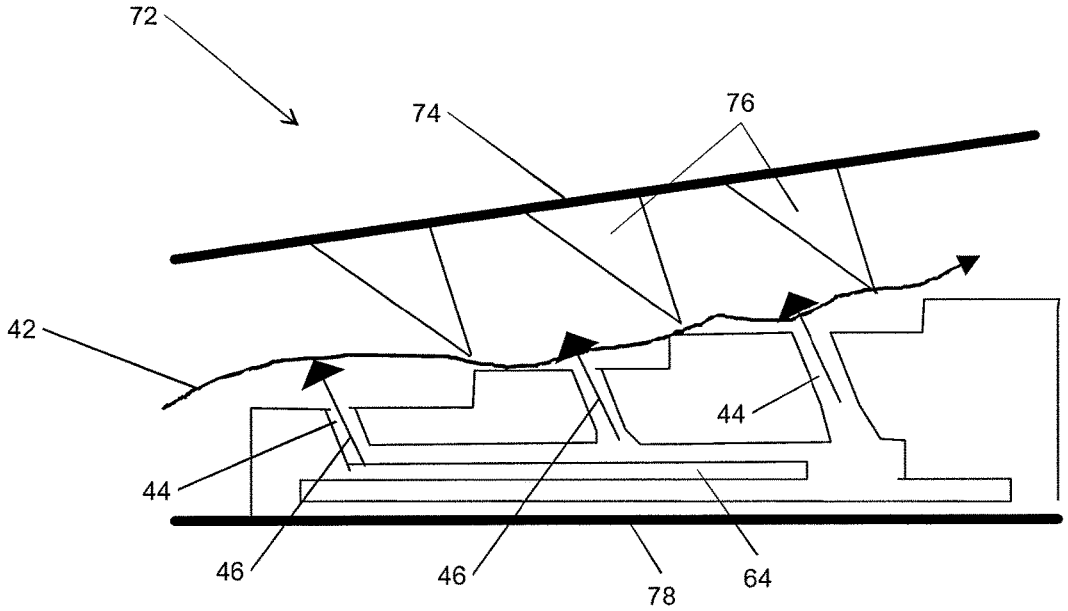
FIG. 10 is a schematic illustration of a seal arrangement to which a clearance control device having a fluidic actuator according to the present invention may be applied.

The fluidic actuator 64 of the present invention has been described for blocking leakage air 52 from flowing through the clearance 40 between blade tips 38 and the casing segment 36 surrounding a rotor stage of a gas turbine engine 10. However, the present invention also finds utility for a seal arrangement 72 as illustrated in FIG. 10. The seal arrangement 72 comprises a seal segment 74 that includes a plurality of seal members 76 in sealing abutment to a rotating component 78. Leakage air flows through the seal as indicated by arrow 42. In accordance with the present invention, a fluidic actuator 64 is provided to deliver injection air 46 to passages 44 through the seal segment 74 and thence to block the leakage air 42.

Advantageously the present invention permits air to be modulated deep inside an engine 10. The present invention may be used for bore flow modulation or for modulation of air flow in other parts of the air system. Alternatively the present invention may be used to modulate other fluids in fluid systems.

The invention claimed is:

1. A fluidic actuator comprising:

a fluid nozzle for delivering fluid;

a tube having an open end and a closed end, the open end spaced from the fluid nozzle, a pair of electrodes mounted in the tube and spaced apart to create a spark gap therebetween; and a voltage source arranged to supply a voltage across the pair of electrodes wherein the voltage causes plasma formation in the spark gap thereby shortening the effective length of the tube.

2. A fluidic actuator as claimed in claim 1 wherein the pair of electrodes are axially aligned and circumferentially spaced.

3. A fluidic actuator as claimed in claim 1 wherein the pair of electrodes are circumferentially aligned and axially spaced.

4. A fluidic actuator as claimed in claim 1 comprising more than one pair of electrodes.

5. A fluidic actuator as claimed in claim 1 comprising more than one voltage source.

6. A fluidic actuator as claimed in claim 1 further comprising a controller connected to the voltage source.

7. A fluidic actuator as claimed in claim 1 wherein the voltage source is arranged to supply a voltage of 1 kV to 20 kV.

8. A fluidic actuator as claimed in claim 7 wherein the voltage source is controlled by a square wave function.

9. A fluidic actuator as claimed in claim 1 wherein the tube has a circular cross-section.

10. A fluidic actuator as claimed in claim 1 wherein the tube has a rectangular cross-section.

11. A fluidic actuator as claimed in claim 1 wherein the tube has a constant diameter for all its axial length.

12. A fluidic actuator as claimed in claim 1 wherein the tube has a different diameter at points along its axial length.

13. A rotor sub-assembly comprising a rotor having an array of blades, a casing segment surrounding the rotor blades and a fluidic actuator as claimed in claim 1, the fluidic actuator arranged to supply fluid to a clearance control arrangement.

14. A seal arrangement comprising the fluidic actuator as claimed in claim 1 comprising a seal segment a rotating component against which the seal acts and a clearance control arrangement arranged to receive fluid from the fluidic actuator.

15. A gas turbine engine comprising a fluidic actuator as claimed in claim 1.

16. A gas turbine engine comprising a rotor sub-assembly as claimed in claim 13.

17. A gas turbine engine comprising a seal arrangement as claimed in claim 14.

* * * * *